US005709380A

United States Patent [19]

Petocchi et al.

[11] Patent Number: 5,709,380

[45] Date of Patent: Jan. 20, 1998

[54] REPLACEABLE COMPACT FEED ROLL UNIT

[75] Inventors: Ermanno C. Petocchi; Bruce J. DiRenzo, both of Rochester, N.Y.

[73] Assignee: Xerox Corporation, Stamford, Conn.

[21] Appl. No.: 515,779

[22] Filed: Aug. 16, 1995

[51] Int. Cl.[6] ..... B65H 3/52

[52] U.S. Cl. ..... 271/125; 271/117; 271/122; 271/124; 271/118

[58] Field of Search ..... 271/117, 122, 271/125, 124, 118

[56] References Cited

U.S. PATENT DOCUMENTS

| | | | |
|---|---|---|---|
| 3,484,099 | 12/1969 | Gallagher | 271/125 |
| 4,208,046 | 6/1980 | Shimizu | 271/122 |
| 5,060,927 | 10/1991 | Sugiura | 271/117 |
| 5,143,365 | 9/1992 | Green | 271/125 |
| 5,244,198 | 9/1993 | Green | 271/125 |
| 5,265,859 | 11/1993 | Watson et al. | 271/109 |
| 5,421,569 | 6/1995 | Davidson | 271/109 |

FOREIGN PATENT DOCUMENTS

| | | | |
|---|---|---|---|
| 33329 | 4/1981 | Japan | 271/117 |
| 166236 | 10/1982 | Japan | 271/117 |
| 165236 | 7/1988 | Japan | 271/117 |

*Primary Examiner*—William E. Terrell
*Assistant Examiner*—Khoi H. Tran
*Attorney, Agent, or Firm*—Kevin R. Kepner

[57] ABSTRACT

A replacement roller cartridge for a cut sheet retard feeder. The cartridge assembly includes a feed roll, a nudger roll, and a retard roll aligned so that the axis of rotation are substantially in the same plane within an articulated frame. The frame is inserted into the feed head and pivoted into an active position. Upon insertion into the feed head, the retard roll is captured by a separate retard bracket so that when the feed head is pivoted into the active position the retard roll is withdrawn from the frame and forms a feed nip with the feed roll. The articulated frame is geared so that the frame folds back against itself to provide a very compact unit. A gear train is provided on both sides of the cartridge to drive the feed roll and the nudger roll. The cartridge assembly provides a low cost, easily replaceable unit that eliminates the need for a service technician to replace worn feed rolls. The design is also adaptable for use in various types of sheet and document feeders and can be used throughout a printing machine. The preassembled cartridge also obviates the need for a technician to calibrate or adjust the positions of the feed rolls as they are locked into position upon insertion and rotation of the cartridge frame into the feed head.

18 Claims, 4 Drawing Sheets

REPLACEABLE COMPACT FEED ROLL UNIT

This invention relates generally to a cut sheet feeder, and more particularly concerns a customer replaceable feed/retard roll CRU (customer replaceable unit) assembly for use in feeding cut sheets in an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. After each transfer process, the toner remaining on the photoconductor is cleaned by a cleaning device.

In printing machines such as those described above, semi-active retard paper feeders are used in document handlers, special material handlers, and in paper supply trays. As currently configured, the feed rollers, when worn, must be replaced by a service technician as a result of designs requiring disassembly of the feed head and replacement of several parts in several different areas in the feeder assembly. It is desirable to have a machine in which the feed head components, namely a nudger roller, a feed roller, a retard roll or pad, are easily replaceable by a customer. This easy replacement allows the customer to avoid a service technician call and also provides that the feed head components can be easily replaced by the customer when worn without down time.

It is also desirous to have a feed head replacement component that is low in cost, very compact and somewhat universal so as to be able to be used in different locations throughout the printing machine. It is further desirable to have a feed head replacement component which does not require extensive adjustment and/or disassembly of the printing machine for replacement.

The following disclosures may be relevant to various aspects of the present invention:

U.S. Pat. No. 5,421,569 Inventor: Davidson Issue Date: Jun. 6, 1995

U.S. Pat. No. 5,265,859 Inventor: Watson et al. Issue Date: Nov. 30, 1993

The relevant portions of the foregoing disclosures may be briefly summarized as follows:

U.S. Pat. No. 5,265,859 describes a replaceable feed roll unit in which includes a feed roll, a nudger roll, and a retard roll aligned so that the axis of rotation are substantially in the same plane within a frame. The frame is inserted into the feed head and pivoted into an active position. Upon insertion into the feed head, the retard roll is captured by a separate retard bracket so that when the feed head is pivoted into the active position the retard roll is withdrawn from the frame and forms a feed nip with the feed roll.

U.S. Pat. No. 5,265,859 describes a roller assembly having first and second rollers connected by a gear train. The driven roller is biased toward a drive connection and the entire assembly snap-fits into a feed head cover.

In accordance with one aspect of the present invention, there is provided an apparatus a unitary feed member apparatus for a feed head assembly for feeding cut sheets from a stack of sheets. The apparatus comprises an articulating frame having a first portion and a second portion pivotally attached to the first portion a plurality of rotatable members mounted in the first portion of the frame and retard member removably mounted in the second portion of the frame adjacent one of the plurality of rotatable members so that when the frame is inserted in the feed head assembly and moved from a first position to a second position, the retard member is released from the second portion of the frame and forms a nip with the adjacent one of the plurality of rotatable members, the second portion of the frame pivoting toward the first portion of the frame to shorten the length of the frame.

Pursuant to another aspect of the present invention, there is provided an electrophotographic printing machine having a sheet feeder having a unitary feed member cartridge for the feed head for feeding cut sheets from a stack of sheets. The cartridge comprises an articulating frame having a first portion and a second portion pivotally attached to the first portion, a plurality of rotatable members mounted in the first portion of the frame and a retard member removably mounted in the second portion of the frame adjacent one of the plurality of rotatable members so that when the frame is inserted in the feed head assembly and moved from a first position to a second position, the retard member is released from the second portion of the frame and forms a nip with the adjacent one of the plurality of rotatable members, the second portion of the frame pivoting toward the first portion of the frame to shorten the length of the frame.

Pursuant to yet another aspect of the present invention, there is provided a customer replaceable unit for a sheet feeder for feeding cut sheets from a stack of sheets. The customer replaceable unit comprises an articulating frame having a first portion and a second portion pivotally attached to the first portion, a plurality of rotatable members mounted in the first portion of the frame and a retard member removably mounted in the second portion of the frame adjacent one of the plurality of rotatable members so that when the frame is inserted in the feed head assembly and moved from a first position to a second position, the retard member is released from the second portion of the frame and forms a nip with the adjacent one of the plurality of rotatable members, the second portion of the frame pivoting toward the first portion of the frame to shorten the length of the frame.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
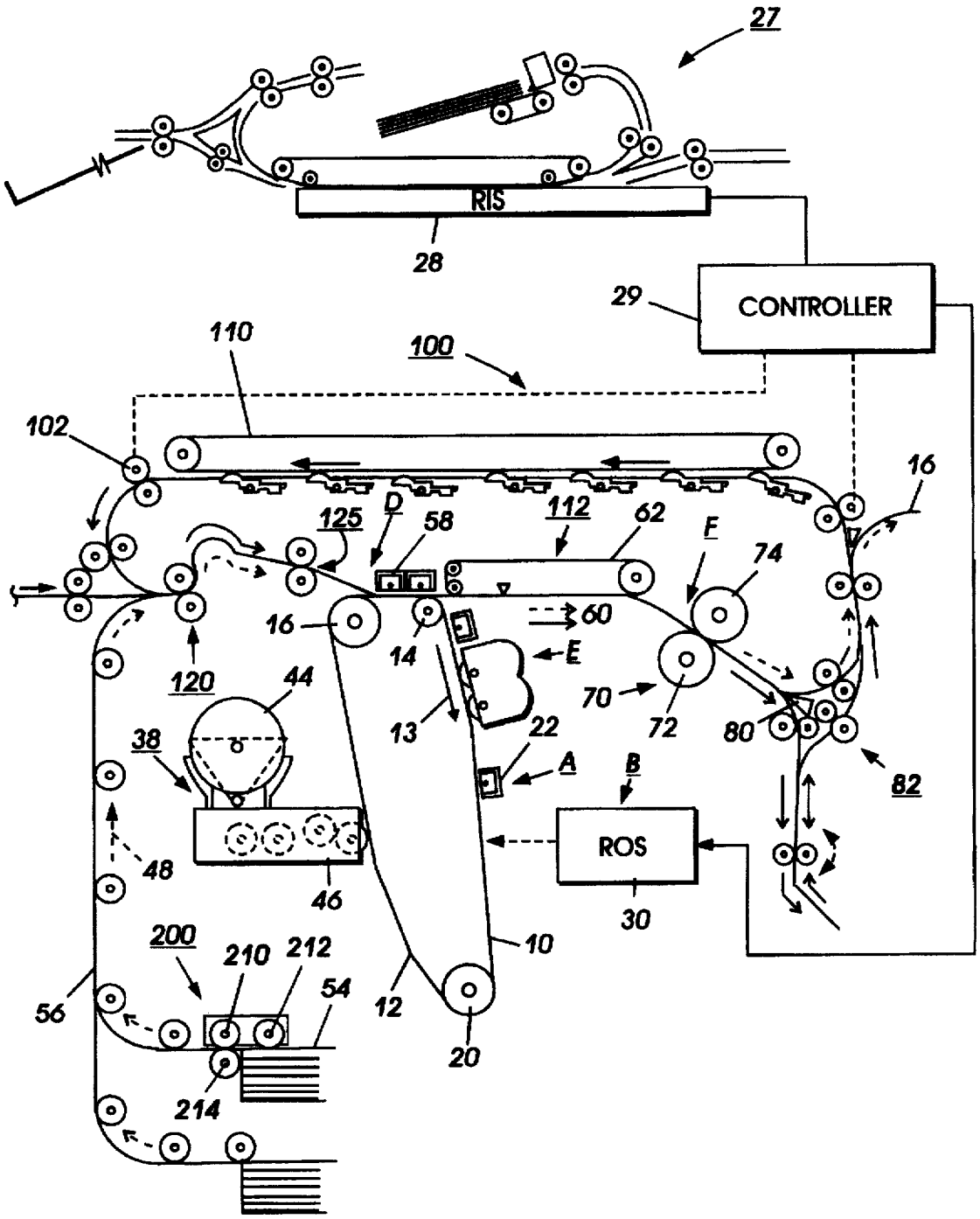
FIG. 1 is a schematic elevational view of a typical electrophotographic printing machine utilizing the feed/retard roll cartridge therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the feed/retard roll cartridge assembly of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. Preferably, a nine facet polygon is used. The ROS illuminates the charged portion of photoconductive belt 10 at a resolution of about 300 or more pixels per inch. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 200. Preferably, sheet feeding apparatus 200 includes a feed roll 212 contacting the uppermost sheet of stack 54. Feed roll 52 rotates to advance the uppermost sheet from stack 54 into vertical transport 56. Vertical transport 56 directs the advancing sheet 48 of support material into registration transport 57 past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 8. This attracts the toner powder image from photoconductive surface 12 to sheet 48. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72.

The sheet then passes through fuser 70 where the image is permanently fixed or fused to the sheet. After passing through fuser 70, a gate 80 either allows the sheet to move directly via output 16 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 16. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 16.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

It is believed that the foregoing description is sufficient for purposes of the present application to illustrate the general operation of an electrophotographic printing machine incorporating the features of the present invention therein.

Figure 2:
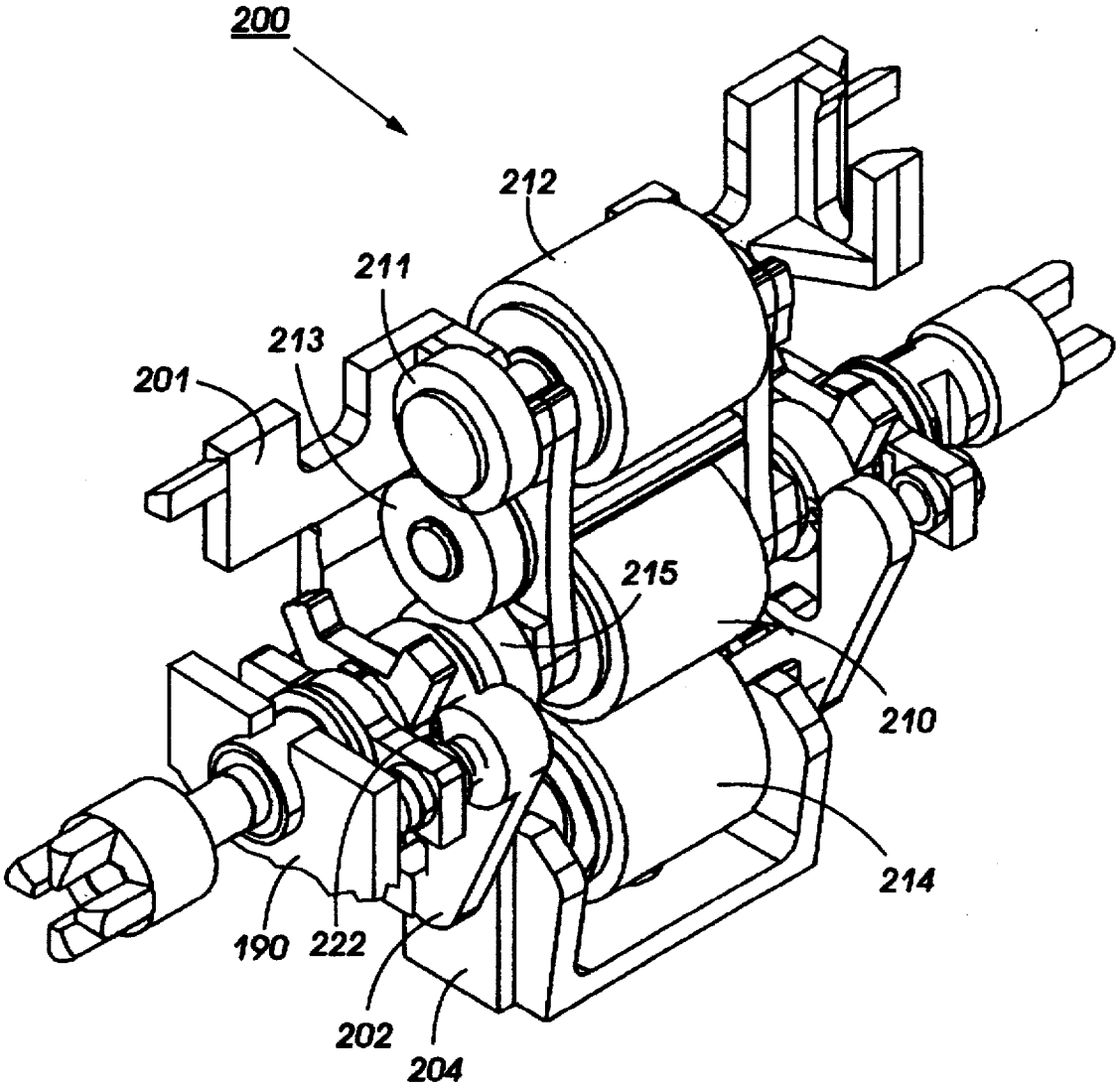
FIG. 2 is a perspective view of the cartridge of the present invention prior to insertion into the feedhead.
Figure 3:
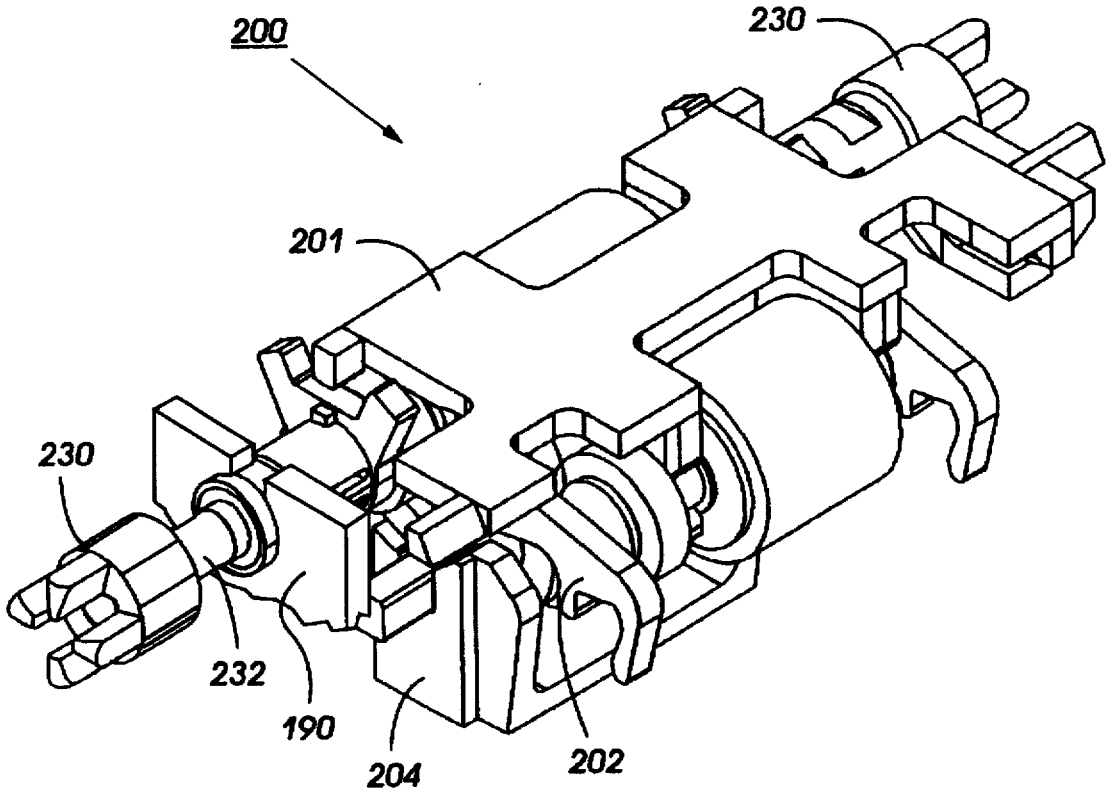
FIG. 3 is a perspective view of the cartridge of the present invention after insertion into the feedhead.

Turning now to FIGS. 2 and 3, there is illustrated a perspective view of the feed head replacement cartridge of the present invention. In FIG. 2, the replacement cartridge 200 is illustrated as being in the vertical position to be inserted into the feed head 190. The replacement cartridge 200 is made of an articulated frame made of two main portions, an upper portion 201 and a lower portion 202 pivotally mounted to the upper portion 201, a feed roll 210, a nudger roll 212, a retard roll 214, and a gear train 211, 213 and 215, to drive both the feed roll and the nudger roll. There are driveshaft connections 230 on each side of the unit 200. It can be seen that the retard roll 214 is supported in notches 203 (FIG. 4) in the frame 202 by stub axles.

The entire feed roll assembly cartridge 200 is inserted in a vertical position into the feed head frame 190 so that driveshaft connections 230 are engaged. Located directly below the slots is the retard roll bracket 204, also having a notch 205 (FIG. 5) for supporting the retard roll stub axles.

Turning next to FIG. 3, the feed roll cartridge 200 is shown inserted into the feed head frame 190 and pivoted to the horizontal position. It can be seen in FIG. 2 that the retard roll 214 is supported both in the cartridge frame 202 and in the retard roll bracket 204 while in FIG. 3 the retard roll is supported only in the retard roll bracket 204. The frame is secured into the feed head by a detent which snap fits the feed roll driveshaft axle 232 in position. This snap fit detent also provides the center point for pivoting the feed-head into the active position as described below.

Figure 4:
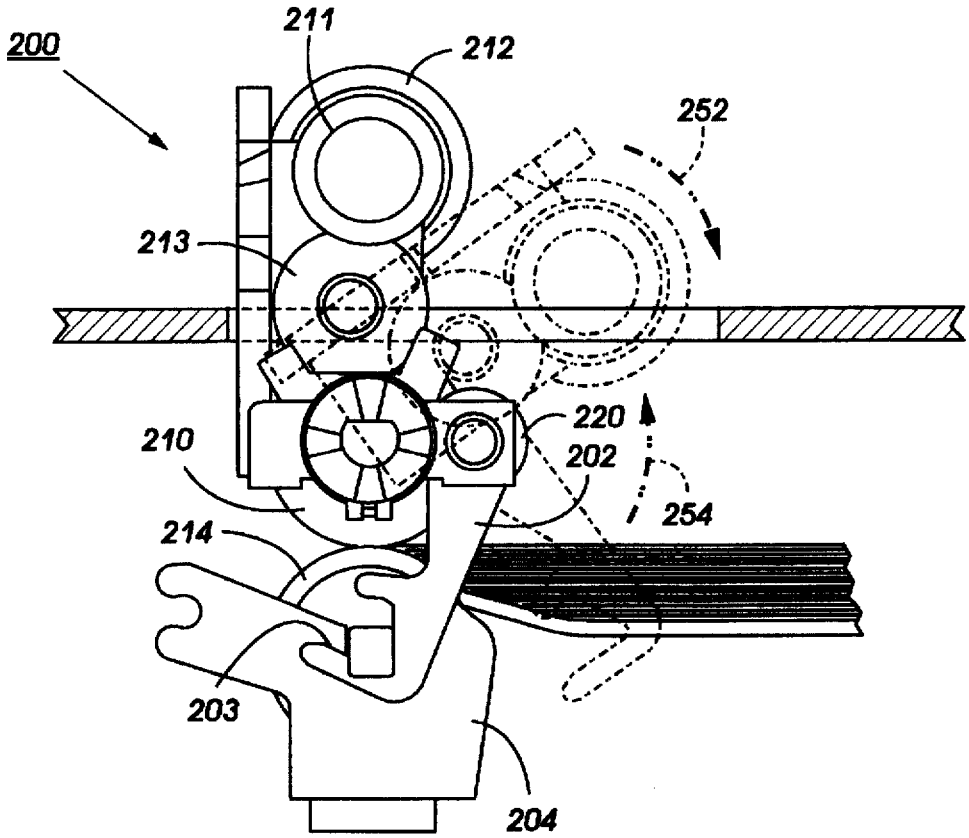
FIG. 4 is a side elevational view of FIG. 2.
Figure 5:
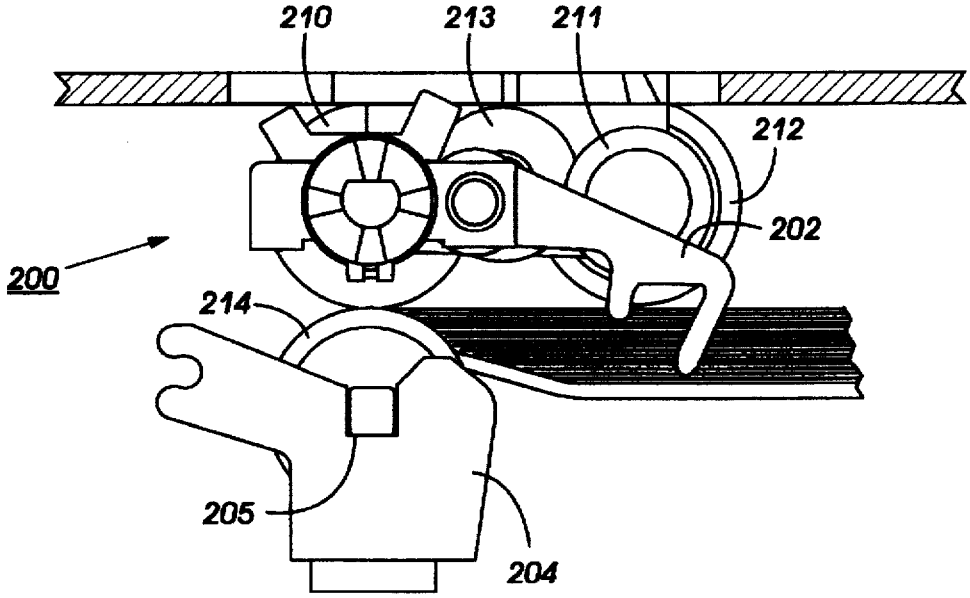
FIG. 5 is an elevational view illustrating the pivoting of the cartridge into the operational position.

Turning next to FIGS. 4 and 5, the feed roll cartridge is shown being rotated into the active position. The entire feed roll cartridge 200 is rotated in the direction of arrow 252 to bring the feed roll 210 and nudger roll 212 into the active position. The entire feed head rotates about the axle 232 of the feed roll 210. As the feed roll cartridge 200 is rotated into the horizontal position, it can be seen (FIG. 4) that the retard roll 214 disengages from the notch 203 in the feed cartridge lower frame 202. The bottom portion of the frame 202 is articulated with respect to the upper portion 201 of the frame. There is a gear mechanism connecting 220, 222 the bottom portion 202 and upper portion 201 of the frame 200 so as the frame is rotated into the active position, the bottom portion 202 rotates up and toward the upper portion 201, thus providing a very compact overall length for the assembly 200. As the lower frame is rotated about the feed roll 210 in the direction of arrow 254, it is seen that the retard roll 214 is now fully supported in the retard roll bracket 204. To remove a worn set of feed rollers, the above procedure is reversed. The upper portion 201 of the frame 200 is pivoted into the vertical position opposite the direction of arrow 252 (FIG. 4) as shown, which causes the lower portion 202 to rotate and recapture the stub axles of retard roll 214 in slot 203. The entire feed cartridge assembly which now includes again the retard roll 214 is then lifted out of the feed head frame 190 and replaced.

The retard roll 214 may be of the type having an internal reversing torque spring/clutch mechanism or it may have a coupler or gear to attach the retard shaft to a reverse driving motor (not shown). The nudger roll 212 contacts the uppermost sheet of the sheet stack 54 and when the feed roll 210 and nudger roll 212 are activated through the gear train 211, 213 and 215 by drive connection 230, the topmost sheet of the stack 54 is fed into the nip between the feed roll 210 and the retard roll 14. This nudger roll/reed roll/.retard roll assembly operates in the same manner as a standard retard roll feeder.

In operation the nudger roll 212 contacts the topmost sheet on the stack and advances the sheet to the nip formed by the feed roll 210 and retard roll 214. When a single sheet enters the nip the friction force between the feed roll 210, the sheet and the retard roll 214 is great enough to overcome and reverse driving force applied to the retard roll 214 by anyone one of several known methods. These methods include actively driven retard rolls utilizing one-way or slip clutches and also spring storage devices and clutches to provide reversing torque. When more than one sheet is forwarded to the nip the frictional force between the sheets is not great enough to overcome the reverse torque on the retard roll and the sheet is driven back toward the sheet stack.

The gear train 211, 213, 215, and the drive connections 230 may be provided on both sides of the cartridge 200 so as to be adaptable to many different utilizations within the printing machine and to be able to be driven from either side of the feed head assembly.

Thus, it can be seen that the feed head cartridge assembly provides for a simple and economical way to replace worn feed rolls and/or retard rolls in a feed head assembly. The simplicity and ease of replacement allows a customer to replace the feed roll assembly without the need to call in or contact a service technician and face the possibility of a delay as a result thereof.

It is also apparent from the drawings herein that the retard roll could be replaced by a retard pad assembly which would be supported in much the same manner as the retard roll and allow for a replacement of a retard pad feed roll/nudger roll assembly in the same manner. Likewise, a feeder belt assembly or a feed roll/nonround nudger member could be substituted for the feed roll/nudger roll and be replaced in the same manner as described above.

The assembly as shown is adaptable to various locations throughout an electrophotographic printing machine or any other type printing machine in which individual cut sheets are fed from the top of a sheet stack. Due to this versatility, the same feed roll design can be located in several locations, thereby reducing the spare part inventory required for a particular machine or machines. The simplicity of the device further allows for user replacement without the need for factory service calls.

In recapitulation, there is provided a replacement roller cartridge for a cut sheet retard feeder. The cartridge assembly includes a feed roll, a nudger roll, and a retard roll aligned so that the axis of rotation are substantially in the same plane within an articulated frame. The frame is inserted into the feed head and pivoted into an active position. Upon insertion into the feed head, the retard roll is captured by a separate retard bracket so that when the feed head is pivoted into the active position the retard roll is withdrawn from the frame and forms a feed nip with the feed roll. A gear train is provided on both sides of the cartridge to drive the feed roll and the nudger roll. The cartridge assembly provides a low cost, easily replaceable unit that eliminates the need for a service technician to replace worn feed rolls. The design is also adaptable for use in various types of sheet and document feeders and can be used throughout a printing machine. The preassembled cartridge also obviates the need for a technician to calibrate or adjust the positions of the feed rolls as they are locked into position upon insertion and rotation of the cartridge frame into the feed head.

It is, therefore, apparent that there has been provided in accordance with the present invention, a customer replaceable feed roll assembly that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A unitary feed member apparatus for a feed head assembly for feeding cut sheets from a stack of sheets, comprising:

an articulating frame having a first portion and a second portion pivotally attached to said first portion;

a plurality of rotatable members mounted in said first portion of said frame;

a retaining member, located in the feedhead assembly; and a retard member removably mounted in said second portion of said frame adjacent one of said plurality of rotatable members so that when said frame is inserted in the feed head assembly and pivotally moved about one of said plurality of rotatable members from a first position to a second position, said retard member is released from said second portion of said frame and captured in said retaining member to form a nip with said adjacent one of said plurality of rotatable members, said second portion of said frame pivoting toward said first portion of said frame to shorten the length of said frame.

2. An apparatus according to claim 1, wherein said rotatable members comprise a first roll and a second roll, each of said rolls mounted rotatably in said frame.

3. An apparatus according to claim 2, wherein said retard member comprises:

a support member mounted in said second portion of said frame; and a retard roll supported on said support member.

4. An apparatus according to claim 3, wherein:

said first roll forms the nip with said retard roll; and said second roll contacts an outermost sheet of the stack and forwards the outermost sheet to the nip.

5. An apparatus according to claim 1, wherein said second portion of said frame defines a notch for supporting said retard member, so that upon pivoting said frame from the first position to the second position, said retard member is released from said second portion of frame.

6. An apparatus according to claim 5, wherein upon pivoting of said frame from the second position to the first position, said retard member is captured in the notch in said second portion of said frame.

7. An electrophotographic printing machine having a sheet feeder having a unitary feed member cartridge for a feed head assembly for feeding cut sheets from a stack of sheets, comprising:

an articulating frame having a first portion and a second portion pivotally attached to said first portion;

a plurality of rotatable members mounted in said first portion of said frame;

a retaining member, located in the feedhead assembly; and a retard member removably mounted in said second portion of said frame adjacent one of said plurality of rotatable members so that when said frame is inserted in the feed head assembly and pivotally moved about one of said plurality of rotatable members from a first position to a second position, said retard member is released from said second portion of said frame and captured in said retaining member to form a nip with said adjacent one of said plurality of rotatable members, said second portion of said frame pivoting toward said first portion of said frame to shorten the length of said frame.

8. A printing machine according to claim 7, wherein said rotatable members comprise a first roll and a second roll, each of said rolls mounted rotatably in said frame.

9. A printing machine according to claim 8, wherein said retard member comprises:

a support member mounted in said second portion of said frame; and a retard roll supported on said support member.

10. A printing machine according to claim 9, wherein:

said first roll forms the nip with said retard roll; and said second roll contacts an outermost sheet of the stack and forwards the outermost sheet to the nip.

11. A printing machine according to claim 7, wherein said second portion of said frame defines a notch for supporting said retard member, so that upon pivoting said frame from the first position to the second position, said retard member is released from said second portion of said frame.

12. A printing machine according to claim 11, wherein upon pivoting of said frame from the second position to the first position, said retard member is captured in the notch in said second portion of said frame.

13. A customer replaceable unit for a sheet feeder having a feed head assembly for feeding cut sheets from a stack of sheets, comprising:

an articulating frame having a first portion and a second portion pivotally attached to said first portion;

a plurality of rotatable members mounted in said first portion of said frame;

a retaining member, located in the feedhead assembly; and a retard member removably mounted in said second portion of said frame adjacent one of said plurality of rotatable members so that when said frame is inserted in the feed head assembly and pivotally moved about one of said plurality of rotatable members from a first position to a second position, said retard member is released from said second portion of said frame and captured in said retaining member to form a nip with said adjacent one of said plurality of rotatable members, said second portion of said frame pivoting toward said first portion of said frame to shorten the length of said frame.

14. A customer replaceable unit according to claim 13, wherein said rotatable members comprise a first roll and a second roll, each of said rolls mounted rotatably in said frame.

15. A customer replaceable unit according to claim 14, wherein said retard member comprises:

a support member mounted in said second portion of said frame; and a retard roll supported on said support member.

16. A customer replaceable unit according to claim 15, wherein:

said first roll forms the nip with said retard roll; and said second roll contacts an outermost sheet of the stack and forwards the outermost sheet to the nip.

17. A customer replaceable unit according to claim 13, wherein said second portion of said frame defines a notch for supporting said retard member, so that upon pivoting said frame from the first position to the second position, said retard member is released from said second portion of said frame.

18. A customer replaceable unit according to claim 17, wherein upon pivoting of said frame from the second position to the first position, said retard member is captured in the notch in said second portion of said frame.

* * * * *